United States Patent [19]

Miller et al.

[11] Patent Number: 4,692,658

[45] Date of Patent: Sep. 8, 1987

[54] IMAGING SYSTEM HAVING AN IMPROVED SUPPORT BEAD AND CONNECTOR

[75] Inventors: Louis D. Miller, Leola; Donald B. Kaiser, Lancaster, both of Pa.

[73] Assignee: RCA Corporation, Princeton, N.J.

[21] Appl. No.: 856,279

[22] Filed: Apr. 28, 1986

[51] Int. Cl.[4] ..... H01J 29/02; H01J 29/82; H01J 31/26

[52] U.S. Cl. ..... 313/365; 313/451; 313/456

[58] Field of Search ..... 313/365, 417, 438, 451, 313/456, 378, 390, 450

[56] References Cited

U.S. PATENT DOCUMENTS

| | | | |
|---|---|---|---|
| 3,143,681 | 8/1964 | Schlesinger | 313/83 |
| 3,223,871 | 12/1965 | Schlesinger | 313/83 |
| 3,265,926 | 8/1966 | Schlesinger | 315/16 |
| 3,286,114 | 11/1966 | Schlesinger | 313/83 |
| 3,307,061 | 2/1967 | Schlesinger | 313/78 |
| 3,319,110 | 5/1967 | Schlesinger | 315/17 |
| 3,327,160 | 6/1967 | Schlesinger | 315/17 |
| 3,375,390 | 3/1968 | Schlesinger | 313/83 |
| 3,666,985 | 5/1972 | Schlesinger | 315/31 |
| 3,774,236 | 11/1973 | Schlesinger | 315/11 |
| 4,205,253 | 5/1980 | Kakizaki et al. | 313/437 |
| 4,258,284 | 3/1981 | Month et al. | 313/390 |
| 4,400,644 | 8/1983 | Hale | 313/256 |

FOREIGN PATENT DOCUMENTS

| | | | |
|---|---|---|---|
| 2145874 | 4/1985 | United Kingdom | 29/46 |
| 2160015 | 12/1985 | United Kingdom | 29/46 |

*Primary Examiner*—David K. Moore

*Assistant Examiner*—K. Wieder

*Attorney, Agent, or Firm*—Eugene M. Whitacre; Dennis H. Irlbeck; Vincent J. Coughlin, Jr.

[57] ABSTRACT

The present imaging system, like prior imaging systems, includes an electron tube and an external solenoid which is disposed around a portion of the tube. An electron gun within the tube has a plurality of support beads located substantially symmetrically around the gun. Each of the beads comprises a body of insulating material having a first major surface and an oppositely disposed second major surface. A recess is formed in the first major surface and extends into the body of the material. A plurality of connectors corresponding to the number of supports beads are also provided. Each of the connectors comprises a single piece of metal having a proximal end, a distal end and a central body interconnecting both ends. The proximal end of each connector includes an embossment which conforms to the curvature of the leads which extend through a stem assembly of the tube. The distal end of each connector includes an arcuate termination that makes a line contact with a terminal of an electrostatic yoke formed on an interior surface of an envelope of the tube. The central body of each connector includes a flat support portion adjacent to the proximal end and a reverse-bend portion disposed between the flat support portion and the distal end. A protrusion extends from the flat support portion of each connector. The protrusions project into the recesses formed in the support beads to secure and longitudinally position the gun. The reverse-bend portions of the connectors provide an inwardly-directed spring force to radially position the electron gun on the longitudinal axis of the envelope.

5 Claims, 6 Drawing Figures

IMAGING SYSTEM HAVING AN IMPROVED SUPPORT BEAD AND CONNECTOR

BACKGROUND OF THE INVENTION

The invention relates to an improved support bead and electrical connector for an imaging system, and more particularly to a one piece connector which addresses the support bead and longitudinally and radially positions an electron gun within an evacuated envelope and provides electrical connection to a separate deflection electrode disposed therein.

U.S. Pat. No. 3,319,110 issued to Schlesinger on May 9, 1967, describes an electron focus projection and scanning (FPS) system which utilized a mixed field system for focusing and deflecting an electron beam. The FPS system comprises a camera tube and an external coil. The coil provides an axially directed magnetic focus field. The tube contains an electrostatic yoke or deflectron formed of pairs of interleaved horizontal and vertical deflection electrodes which are attached or formed on the interior surface of the tube envelope. The electrostatic yoke generates a rotatable, bi-axial uniform electric field orthogonal to the magnetic field generated by the coil. The crossed electric and magnetic fields constitute a "focus projection and scanning" or "FPS" cavity in the central portion of the tube envelope. An FPS system provides high image resolution, high beam current density with minimum power requirements, size and weight. Conventional all-electrostatic imaging systems have an inherently long beam system and all-magnetic imaging systems are bulky, heavy and require a large amount of power. Therefore, in applications where power requirements, size and weight are to be minimized, the FPS system is preferred. It is also desirable to design the system to be very rugged and capable of withstanding severe shock and vibration, such as are encountered in military and space exploration applications. It is known that an electron gun assembly for such a system application should have low mass, and be well centered within the tube and aligned with the longitudinal axis of the tube envelope.

One prior art electron gun 10 is shown in FIG. 1. The electron gun 10 comprises a cathode assembly 12, a control grid (G1) electrode 14 and a screen grid (G2) assembly 16. The G1 electrode 14 and the G2 assembly 16 are secured in spaced-apart relation to one another by three equally spaced glass support beads 18 (only one of which is shown). The G1 electrode 14 is a deep-drawn cup having a sidewall 20. The cathode assembly 12 is disposed within the G1 electrode 14 and spaced therefrom by a ceramic spacer 22 and a ceramic feed-through 24. An annular ceramic member 26 circumscribes the sidewall 20 of the G1 electrode 14. The ceramic member 26 is longitudinally positioned along the sidewall 20 by means of three equally spaced shims 28 (only one of which is shown) and a support ring 30. The ceramic member 26 has four asymmetrially spaced apertures 32 (only one is shown) formed therethrough. A loop-strap 34 having a separate button 36 is attached thereto is disposed between the aperature 32 in the ceramic member 26 and a conductive pattern 38 formed on the interior wall of a tube envelope 40. The conductive pattern 38 comprises one of the four identical patterns which form the electrostatic yoke (now shown). The patterns 38 comprise a metal film, such as nickel. A separate electrical connector 42 is attached between the end of the loop-strap 34 adjacent to the button 36 and a stem lead 44. Three additional (but not shown) loop-straps 34, buttons 36, and electrical connectors 42 are required to longitudinally and radially position the electron gun 10 and to make electrical connections to the four conductive patterns 38 of the electrostatic yoke. The positioning structure, comprising ceramic member 26, shims 28, support ring 30, loop-straps 34, buttons 36 and electrical connectors 42, is complex and adds undesirable mass to the electron gun 10. Additionally, the loop-straps 34, formed of a flat strip, tend to scratch the conductive patterns 38 creating metal particles and reducing the integrity of the electrical connection to the electrostatic yoke. The three-piece construction of the loop-strap 34, button 36 and electrical connector 42 adds additional cost while decreasing the precision with which the electron gun 10 is located within the tube envelope 40. Finally, the asymmetric locations of the apertures 32 in the ceramic member 26 require that the corresponding loop-straps 34 also be asymmetrically placed relative to the electron gun 10. This asymmetrical positioning tends to radially displace the electron gun 10 relative to the longitudinal axis of the tube.

Accordingly, a need exists for a simple, reliable structure that will longitudinally and radially position the electron gun in relation to the longitudinal axis of the tube without damaging the electrostatic yoke pattern on the interior wall of the tube envelope.

SUMMARY OF THE INVENTION

An imaging system for focusing and deflecting an electron beam comprises an evacuated envelope structure having a longitudinal axis and magnetic field means for generataive a substantially uniform magnetic field within and along the axis of the envelope. Electric field means are provided within the envelope for generating a variable substantially uniform electric field therein to deflect the electron beam along two coordinates of the system. The electric field is orthogonal to the magnetic field. An electron gun is disposed within the envelope for generating and directing an electron beam through the fields. The electron gun includes a cathode, a first grid electrode and a second grid electrode secured in spaced-apart relation by a plurality of support beads located substantially symmetrically around the electron gun. A target is located within the envelope opposite the electron gun. The target is disposed in a plane perpendicular to the longitudinal axis of the envelope. Each of the support beads of the electron gun is formed of a body of insulating material having two opposed major surfaces. A recess is formed in one major surface of each bead. The recess extends into the body of the insulating material. A plurality of connectors, corresponding in number to the number of support beads, comprise a single conductive member having a proximal end, a distal end and a central body extending therebetween. The proximal end of each connector is attached to a portion of the envelope structure and the distal end is in contact with the electric field means. The central body of each connector includes a flat support portion adjacent to the proximal end and a reverse-bend portion disposed between the flat support portion and the distal end. The flat support portion of each connector has a protrusion extending therefrom which projects into the recess of one of the support beads to secure the electron gun. The reverse-bend portion of each connector provides biasing means to radially position the electron gun on the longitudinal axis.

DETAILED DESCRIPTION OF THE PREFERRED EMBODIMENT

Figure 2:
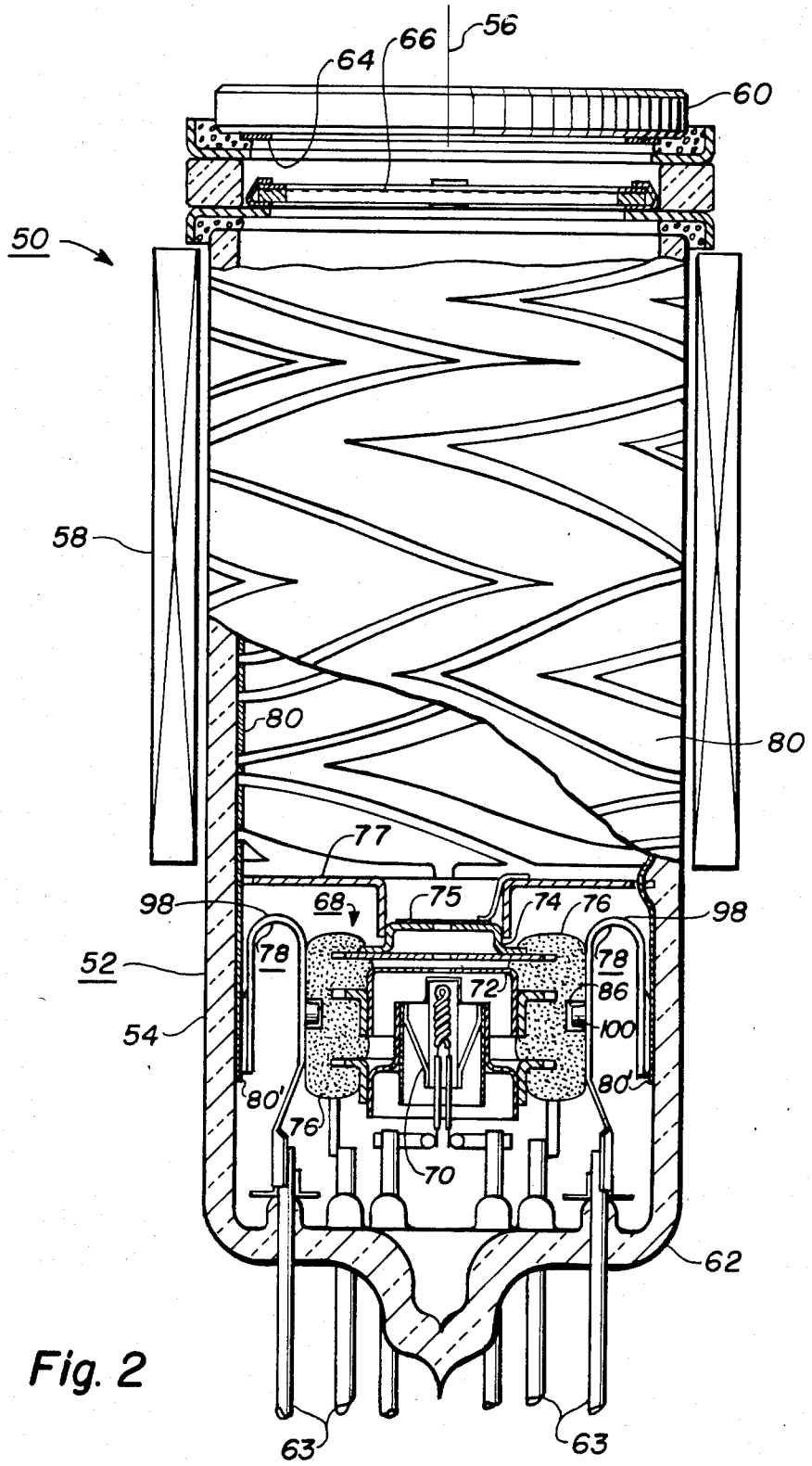
FIG. 2 is an enlarged sectional view, partially in section of an imaging system according to the present invention.

With reference to FIG. 2, an imaging system 50 comprises an FPS camera tube 52 having an evacuated envelope 54 with a longitudinal axis 56. A solenoid 58 is positioned over the exterior surface of the envelope 54, surrounding and axially extending along the central portion of the envelope. The solenoid comprises magnetic field means for generating a substantially uniform magnetic field along the axis 56 and within the envelope 54. A faceplate 60 closes one end of the envelope 54 and a stem assembly 62 closes the oppositely disposed other end of the envelope. The stem assembly 62 includes a plurality of conductive stem leads 63 extending therethrough. A target 64 is disposed adjacent to the faceplate 60 and in a plane perpendicular to the longitudinal axis 56. The target 64 may be formed of silicon, antimony trisulfide or any of the other target materials known in the art. In the preferred embodiment, the target 64 comprises a silicon wafer of the type described in U.S. Pat. No. 4,547,957, issued to Savoye et al. on Oct. 22, 1985, which is incorporated by reference herein for the purpose of disclosure. A mesh electrode 66 is spaced from the target 64 to decelerate an electron beam (not shown) that is generated and directed from an electron gun 68 disposed within the envelope 54 adjacent to the stem assembly 62.

The electron gun 68 comprises a cathode assembly 70, to control grid (G1) electrode assembly 72 and an anode electrode assembly 74 having a beam limiter 75 attached thereto. The aforementioned gun elements are secured in spaced-apart relation to a plurality of novel suport beads 76 which are symmetrically disposed around the electron gun 68. An anode support 77, secured to the interior surface of the envelope 54, centers the top end of the electron gun 68 and makes electrical contact to the beam limiter 75. The elements of the electron gun 68 are electrically connected to selected ones of the stem leads 63 as is known in the art. The electron gun 68 is longitudinally and radially located by a plurality of connectors 78 which communicate with the support beads 76, as described hereinafter. In the preferred embodiment, four support beads 76 and four connectors 78 are used. An electrostatic yoke or deflectron 80 is disposed within the envelope 54 between the electron gun 68 and the mesh electrode 66. The electrostatic yoke 80 is attached or formed on the interior surface of the envelope 54, for example by plating or coating a suitable conductive material thereon. The yoke 80 is coextensive with the solenoid 58 and comprises electric field means for generating a substantially uniform electric field along the axis 56 within the envelope 54. The yoke 80 includes two pairs of electrodes interleaved in a zig-zag pattern which provide simultaneous horizontal and vertical deflection forces on the electron beam. The yoke 80 has four terminals 80', only two of which are shown in FIG. 2. The terminals 80' extend longitudinally along the interior surface of the envelope 54 toward the stem assembly 62. Electrical connection between the four terminals 80' of the yoke 80 and selected stem leads 63 is provided by the connectors 78. The operation of an FPS tube is well known in the art and is described, for example, in the above-referenced U.S. Pat. No. 3,319,110 to Schlesinger.

Figure 3A:
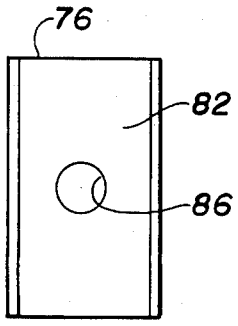
FIGS. 3*a* and 3*b* are an enlarged plan view and a partial side section view of a novel support bead.
Figure 3B:
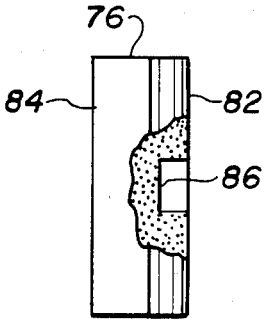

Each of the novel support beads 76, shown in FIGS. 2 and 3, is a substantially rectangularly-shaped member about 8.4 mm (millimeters) long by about 5.1 mm wide by about 3 mm thick. The beads are formed by compacting or pressing a suitable insulating material such as glass powder in a mold. The beads are fired or glazed after molding to outgas the material, to fix the dimensions of the beads and to strengthen the beads and make them less likely to chip and crack. The beads 76 have a first major surface 82 and an oppositely disposed second major surface 84. A recess 86 having a diameter of about 1.52 to 1.65 mm is formed in the first major surface 82 of the support bead 76. The recess 86 extends into the body of the insulating material to a depth of about 0.64 to 0.76 mm which is less than the thickness of the bead. The recess is centered with respect to the first major surface. While a circular recess 86 is preferred, the recess may be any shape and still be within the scope of the invention. Preferably the four beads 76 are located at 90° intervals around the periphery of the electron gun 68 and are used to secure the gun elements together. The recess 86 of each bead is directed outwardly toward the interior surface of the envelope 54.

Figure 4A:
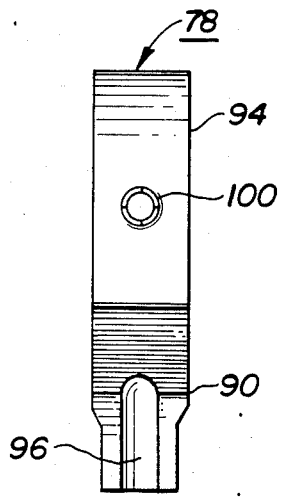
FIGS. 4*a* and 4*b* are an enlarged plan view and a side view respectively, of a novel connector.
Figure 4B:
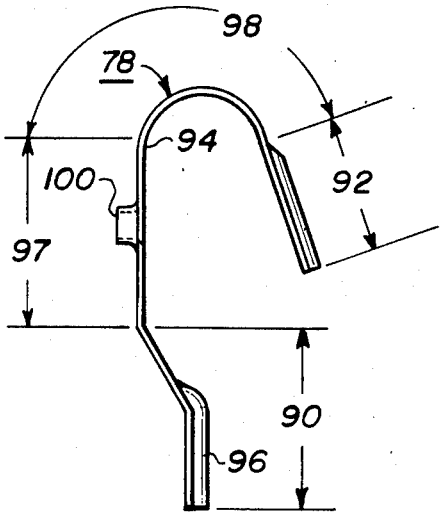

Each of the novel connectors 78, shown in FIGS. 2 and 4, is formed from a single strip of metal such as Inconel or its equivalent. The strip is preferably about 0.13 mm thick and about 3.2 mm wide. The connector 78 has a proximal end 90, a distal end 92 and a central body 94 interconnecting the proximal and distal ends 90 and 92 respectively. The proximal end 90 has an embossment 96 formed therein which conforms to the curvature of the stem lead 63. The embosssment 96 encircles only about half of the circumference of the stem lead 63 to facilitate placement and welding of the connector 78 to the stem lead 63. The distal end 92 includes a termination which is arcuately shaped to make a line-contact with the electrostatic yoke terminal 80'. A line-contact is an elongated longitudinally extending contact and provides greater electrical integrity then, for example, a point contact. By way of example and not limitation, the distal end 92 is formed to a radius of about 5.1 mm. This curvature also aids in preventing scratching or abrading of the terminal 80'. The central body 94 of the connector 78 includes a flat support portion 97 adjacent to the proximal end 90 and a reverse-bend portion 98 disposed between the flat support portion 97 and the distal end 92. A protrusion 100 is formed in and extends outwardly from the flat support portion 97 of the connector 78. The protrusion 100 has an outside diameter of about 1.3 to 1.4 mm and extends a maximum of about 0.5 above the flat support portion 97. As shown in FIG. 2, the protrusions 100 project into the recesses 86 formed in the support beads 76 to secure and position the electron gun longitudinally with respect to the stem leads 63. The reverse-bend portions 98 of the connectors 78 act as springs to exert a radially directed inward spring force to radially position the apertures of the electron gun 68 on the longitudinal axis 56 of the envelope 54.

GENERAL DISCUSSION

Figure 1:
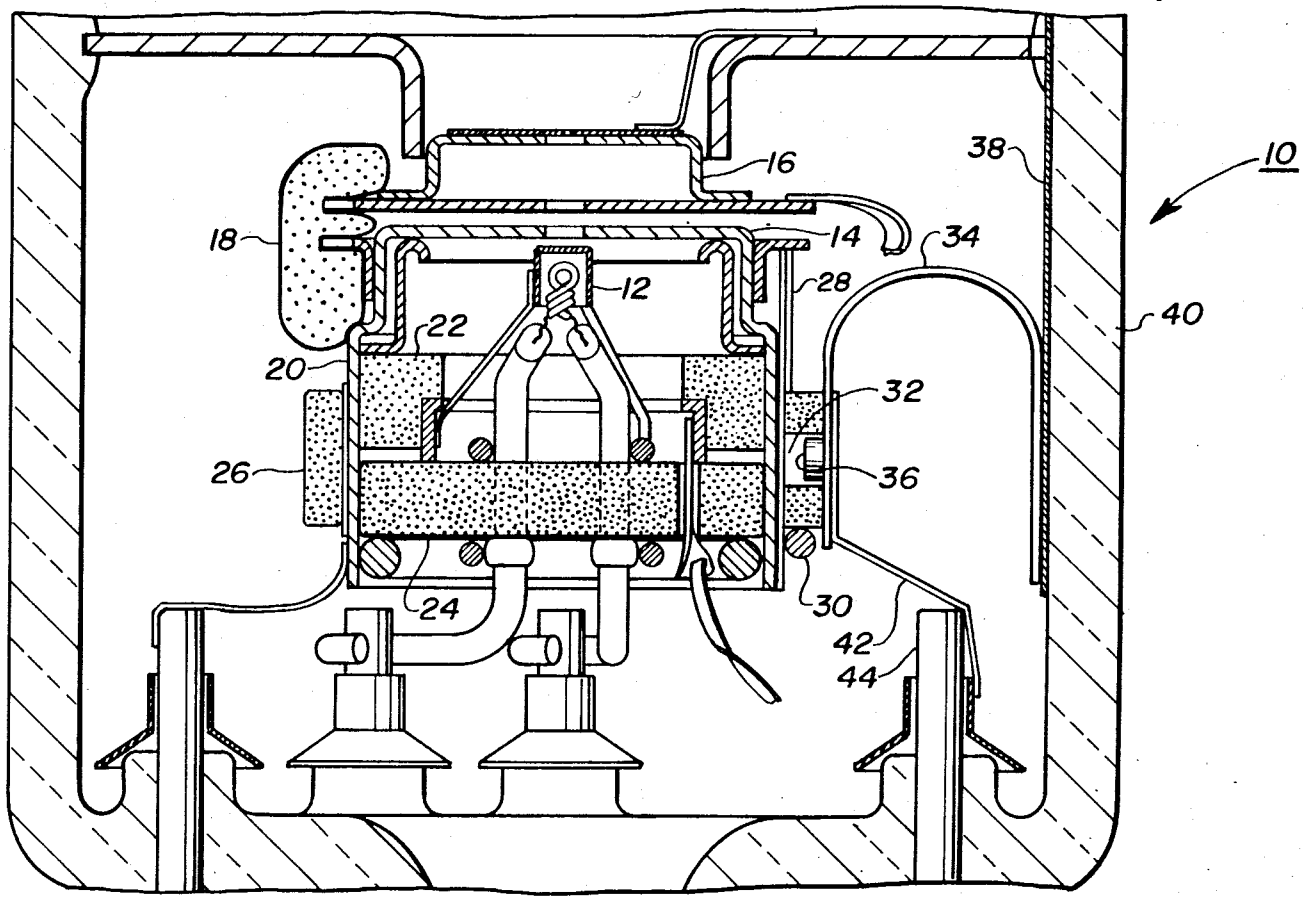
Fig. 1 PRIOR ART
FIG. 1 is an enlarged elevational view, in section of a prior electron gun.

The present electron gun 68, shown in FIG. 2, uses four symmetrically located support beads 76 and connectors 78 to longitudinally position and radially align the electron gun with the longitudinal axis 56 of the envelope 54. The longitudinal axis 56 is also the optical axis of the imaging system 50. In contrast to the prior art electron gun 10, shown in FIG. 1, the present gun 68 provides more accurate gun positioning and alignment with fewer parts. For example, in the prior gun 10 a separate ceramic member 26 having four asymmetrically located apertures 32 is addressed by four locating elements each comprising three separate members, a loop-strap 34, a button 36 and an electrical connector 42, which are welded together. Unlike the novel connector 78, the prior locating element does not have an embossment formed in the proximal end of the electrical connector 42 which conforms to the curvature of the stem lead. Thus, the alignment or placement of the prior art connector 42 on the stem lead is not as precisely controlled as it is with the novel connector 78. Further misalignment of the prior structure can result by improper positioning of the button 36 on the loop-strap 34. Improper positioning of the button 36 results in the inability of the button 36 to index with the aperture 32, or in a distortion of the locating element to permit indexing of the button in the aperture. Such a distortion produces a resultant spring force which tends to misalign the electron gun 10 relative to the longitudinal axis of the envelope. Still another problem in the prior art structure is that the ends of the flat loop-straps 34, which contact the conductive patterns 38 deposited on the interior surface of the envelope, are not arcuately shaped to make line contact with the patterns. Thus, the edges of the flat loop-straps 34 scratch and abrade the patterns 38 causing particles within the tube and poor electrical connection to the patterns.

In applicant's electron gun 68 the support beads 76 simultaneously perform two functions: first, they secure and support in spaced-apart relation the various elements of the electron gun; and second, they have recesses 86 formed in one surface thereof which index with the protrusions 100 on the connectors 78 to longitudinally position and radially align the electron gun 68 on the longitudinal axis 56 of the envelope. The novel support beads 76 thus perform the function of the prior support beads 18 and of the separate ceramic member 26 of the prior art electron gun 10.

This reduction in the number of electron gun parts in the present electron gun 68, compared to the prior electron gun 10, reduces the mass of the present electron gun 68, simplifies its assembly, and translates into a lower cost electron gun which is better able to withstand a hostile operating environment without a decrease in image system performance.

What is claimed is:

1. In an imaging system for focusing and deflecting an electron beam comprising:

an evacuated envelope structure having a longitudinal axis;

magnetic field means for generating a substantially uniform magnetic field along said axis within said envelope;

electric field means for generating a variable substantially uniform electric field within said envelope to deflect said electron beam along two coordinates of said system, said electric field being orthogonal to said magnetic field;

an electron gun disposed within said envelope for generating and directing said electron beam through said magnetic and electric fields, said electron gun including a cathode, a first grid electrode and a second grid electrode secured in spaced-apart relation by a plurality of support beads located-substantially symmetrically around said electron gun; and a target located within said envelope opposite said electron gun, said target being disposed in a plane perpendicular to said longitudinal axis, the improvement wherein each of said support beads of said electron gun comprising a body of insulating material having a first major surface and an oppositely disposed second major surface, said first major surface having a recess formed therein which extends into said body of the insulating material to a depth less than the thickness of the bead, and a plurality of connectors corresponding in number to said plurality of support beads, each of said connectors comprising a single integral conductive member having a proximal end, a distal end and a central body interconnecting said proximal and distal ends, said proximal end of each of said connectors being attached to a portion of said envelope structure, said distal end of each of said connectors being in contact with said electric field means, said central body including a flat support portion adjacent to said proximal end and a reverse-bend portion disposed between said flat support portion and said distal end, said flat support portion of each of said connectors having a protrusion extending therefrom, the protrusions projecting into the recesses formed in said support beads to secure said electron gun, said reverse-bend portion of each of said connectors providing biasing means to radially position said electron gun on said longitudinal axis.

2. In an electron tube of the type comprising:

an evacuated envelope having oppositely disposed ends and a longitudinal axis;

a faceplate closing one end of said envelope;

a target adjacent to said faceplate and disposed in a plane perpendicular to said longitudinal axis;

a stem assembly closing the opposite end of said envelope, said stem assembly having a plurality of conductive stem leads extending therethrough.

an electron gun disposed within said envelope for generating and directing an electron beam, said electron gun including a cathode and at least two successive electrodes secured in spaced-apart relation by a plurality of support beads located substantially symmetrically around said electron gun, said electron gun being electrically connected to selected ones of said stem leads, and an electrosatic yoke disposed within said envelope for generating a variable substantially uniform electric field therein to deflect said electron beam along two coordinates, the improvement wherein each of said support beads of said electron gun comprising a body of insulating material having a first major surface and an oppositely disposed second major surface, said first major surface having a recess formed therein which extends into said body of insulating material to a depth less than the thickness of the bead, and a plurality of connectors corresponding in number to said plurality of support beads, each of said connectors comprising in single integral conductive member having a proximal end, a distal end and a central body interconnecting said proximal and distal ends, said proximal end of each of said connectors being attached to one of said stem leads, said distal end of each of said connectors being in contact with said electrostatic yoke, said central body including a flat support portion adjacent to said proximal end and a reverse-bend portion disposed between said flat support portion and said distal end, said flat support portion of each of said connectors having a protrusion extending therefrom, the protrustions projecting into the recesses formed in said support beads to secure and longitudinally position said electron gun, said reverse-bend portion of each of said connectors providing an inwardly-directed spring force to radially positions said electron gun on said longitudinal axis.

3. The tube as described in claim 2, wherein said proximal end of each of said connectors includes an embossment which conforms to the curvature of a portion of said stem lead to facilitate attachment thereto.

4. The tube as described in claim 2, wherein said electrostatic yoke is form on an interior surface of said envelope, said yoke being divided into four separate patterns, each of said patterns having a terminal.

5. The tube as described in claim 4, wherein said distal end of each of said connectors include an arcurate termination that makes a line contact with said terminal of one of said yoke patterns.

* * * * *